United States Patent [19]

Grimstad

[11] Patent Number: 4,757,560

[45] Date of Patent: Jul. 19, 1988

[54] TOILET TANK GASKET

[75] Inventor: Ronald N. Grimstad, Sheboygan, Wis.

[73] Assignee: Kohler Co., Kohler, Wis.

[21] Appl. No.: 54,135

[22] Filed: May 14, 1987

Related U.S. Application Data

[63] Continuation of Ser. No. 831,097, Feb. 24, 1986, abandoned, which is a continuation of Ser. No. 689,710, Jan. 8, 1985, abandoned.

[51] Int. Cl.[4] ..... E03D 11/00

[52] U.S. Cl. ..... 4/417; 4/252 R; 277/166

[58] Field of Search ..... 4/417–419, 4/191, 252 R; 285/363, DIG. 22; 277/178, 177, 185, 186, 166, 235 B

[56] References Cited

U.S. PATENT DOCUMENTS

| | | | |
|---|---|---|---|
| 548,706 | 10/1895 | Gundermann . | |
| 572,124 | 12/1896 | McElroy | 285/363 |
| 1,969,640 | 8/1934 | Curtin | 277/166 |
| 2,167,354 | 7/1939 | Gavin | 4/417 |
| 2,520,575 | 8/1950 | Smith | 4/417 |
| 2,743,460 | 5/1956 | Youngstrom et al. . | |
| 2,772,034 | 11/1956 | Richmond, Jr. | 277/178 |
| 3,142,845 | 8/1964 | Fulton . | |
| 3,448,466 | 6/1969 | Haldopoulos . | |
| 3,568,222 | 3/1971 | Gantzert | 4/252 R |
| 4,227,722 | 10/1980 | Barber . | |

FOREIGN PATENT DOCUMENTS

| | | | |
|---|---|---|---|
| 2252965 | 5/1973 | Fed. Rep. of Germany . | |
| 1347776 | 11/1962 | France | 4/417 |

OTHER PUBLICATIONS

Eljer–"Repair Parts for Eljer 141-1175 Watersaver Tank Assembly", date unknown.

*Primary Examiner*—Henry J. Recla
*Assistant Examiner*—Linda J. Sholl
*Attorney, Agent, or Firm*—Quarles & Brady

[57] ABSTRACT

A one piece gasket for a toilet which eliminates the use of separate sealing washers and spacing devices is disclosed. The one piece gasket is formed with flange portions extending from a central sealing portion and has upstanding connectors (with fastener through bores) extending from the flange portions. The connectors can have an enlarged washer head and a bumper element. The washer heads provide an expansion fit into tank fastener holes for preliminary positioning of the gasket. In a preferred manner, the washer heads are of a frusto-conical configuration.

6 Claims, 2 Drawing Sheets

TOILET TANK GASKET

This application is a continuation of application Ser. No. 831,097, filed 2/24/86 now abandoned, which is a continuation of Ser. No. 689,710 filed 1/8/85 now abandoned.

BACKGROUND OF THE INVENTION

This invention relates to a one piece toilet tank gasket for use under the tank bottom wall. It also functions to provide washer surfaces inside the tank and cushionary bumpers between the tank bottom and bowl extension.

In assembling a toilet tank to a toilet bowl in a "two piece" type toilet, the tank bottom wall usually rests on a rearward extension from the bowl. It is then necessary to employ several fastening and sealing components to connect the outlet of the tank to the inlet of the toilet extension, and also to secure the toilet tank to the toilet bowl. Usually, several bolt holes are formed in the tank bottom wall and bowl extension upper wall. Bolts then extend through these holes. To prevent leakage, a washer is then required in the tank (under the bolt head). Also, a gasket is required under the tank bottom wall to seal between the tank bottom wall and the extension. In addition, cushionary bumpers are usually inserted around each bolt (between the tank and bowl extension).

This results in the use of numerous component parts which can be easily misplaced or discarded, and a time consuming and somewhat complex assembly. While the bumpers have on occasion been formed integrally with the gasket, these parts were all for placement outside of the tank, and separate washers still had to be used even with the improved construction.

It is therefore an advantage of the present invention to afford a one piece gasket unit which includes washers mountable inside the tank which are also connected to the other gasket parts that remain outside the tank. Another advantage is a one piece gasket for use in the sealing arrangement between a toilet tank and a toilet bowl which simplifies installation.

SUMMARY OF THE INVENTION

The foregoing advantages are accomplished and the shortcomings of the prior art overcome by the present gasket. It provides sealing engagement between a bottom surface of a toilet tank that has a tank outlet opening therethrough, and an upper surface of a toilet bowl extension that has an inlet opening therethrough. The gasket is suitable for use when the tank and bowl extension are secured together by a fastener extending through fastener holes in the tank bottom and extension top.

The gasket includes a gasket wall having an opening therethrough that is alignable with the tank outlet and extension inlet and also has a sealing portion around the gasket opening that is suitable to be sandwiched by the tank bottom and bowl extension top. A connector is attached to the gasket wall and extends upwardly therefrom. It has an axial fastener through bore and also an enlarged washer head adjacent its upper end. The axial through bore may be aligned with a tank fastener hole when the gasket wall opening has been aligned as previously indicated and the washer head may be expansion fitted through the tank fastener hole to form a washer in the tank when the gasket wall is still outside.

Preferably, the washer head is of a frusto-conical configuration and the washer head, connector and gasket are all integrally formed. Also preferably, a thickened bumper section is formed integrally with the gasket wall surrounding the fastener through bore under the washer, so as to provide a cushion between the tank and extension. In addition, the sealing portion may comprise a depending lower ring suitable to surrounding the gasket wall opening and an upper washer ledge.

DESCRIPTION OF THE DRAWINGS

A better understanding of the gasket of the present invention will be accomplished by reference to the drawings wherein.

FIG. I is an exploded assembly view, with a part of a tank broken away, illustrating the gasket of this invention during assembly between a toilet tank and a toilet bowl.

DESCRIPTION OF THE PREFERRED EMBODIMENT

Figure 1:
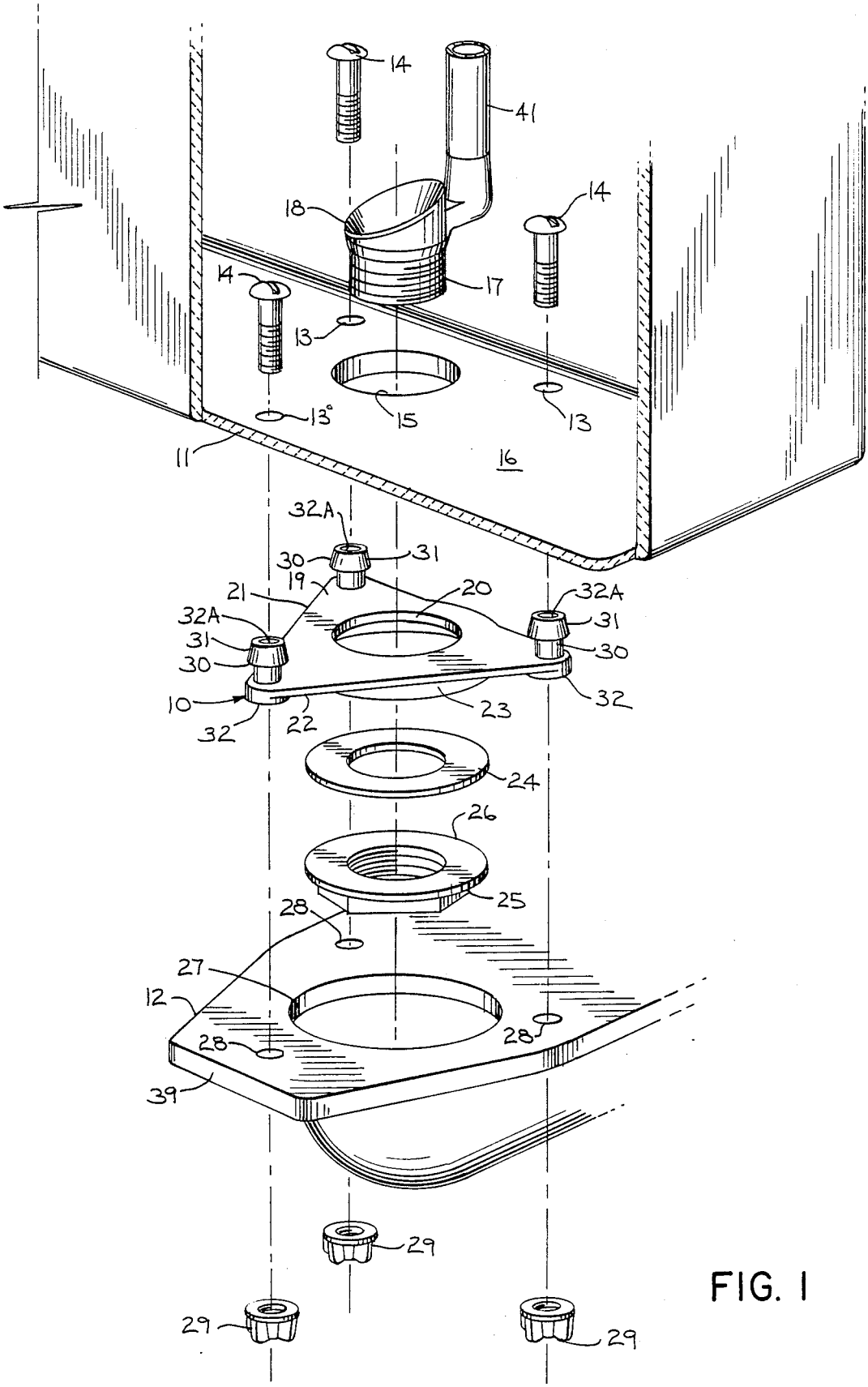

Proceeding to a detailed description of the toilet tank gasket of this invention (generally 10), and particularly a description of FIG. 1, the gasket 10 is shown positioned between a standard toilet tank 11 and a standard toilet bowl extension 12. The toilet tank 11 will have the usual fastener openings 13 for the passage of the bolts 14 therethrough. A central opening 15 is also provided through the bottom wall 16 for the reception of a lower portion of the flush valve 18. The usual inlet pipe 41 provides a source of water to the flush valve 18.

The one piece toilet tank gasket 10 includes a substantially flat gasket wall portion 19 in which is formed an opening 20 for orientation with the opening 15 in the toilet tank 11. The wall 19 has opposing sides 21 and 22 with a central depending sealing ring 23 extending from the lower side 22 and including an annular lip member 33 surrounding an annular washer ledge 34. This is best seen in conjunction with FIGS. 2, 3 and 4.

A separate and optional friction washer 24 can be accommodated within the lip member 33 of ring 23, and will be held therein by the flange 26 of the valve nut 25. The usual opening 27 is provided in the toilet bowl extension 12 into which will be positioned the lower portion 17 of the flush valve 18. The usual fastener openings 28 are also provided in the flange section 39 of the toilet bowl extension 12 for the reception of the bolts 14 to which will be attached the nuts 29.

Referring specifically to the toilet tank gasket 10, it will be seen that there are three mushroom-like connector members 30 which extend upwardly from the wall 19. Each will have a frusto-conical washer head end portion 31 at one end with the small diameter portion disposed at the upper end. There is also for each a spacing bumper element 32 at the lower end. The connectors also have axial through bores 32A.

Figure 4:
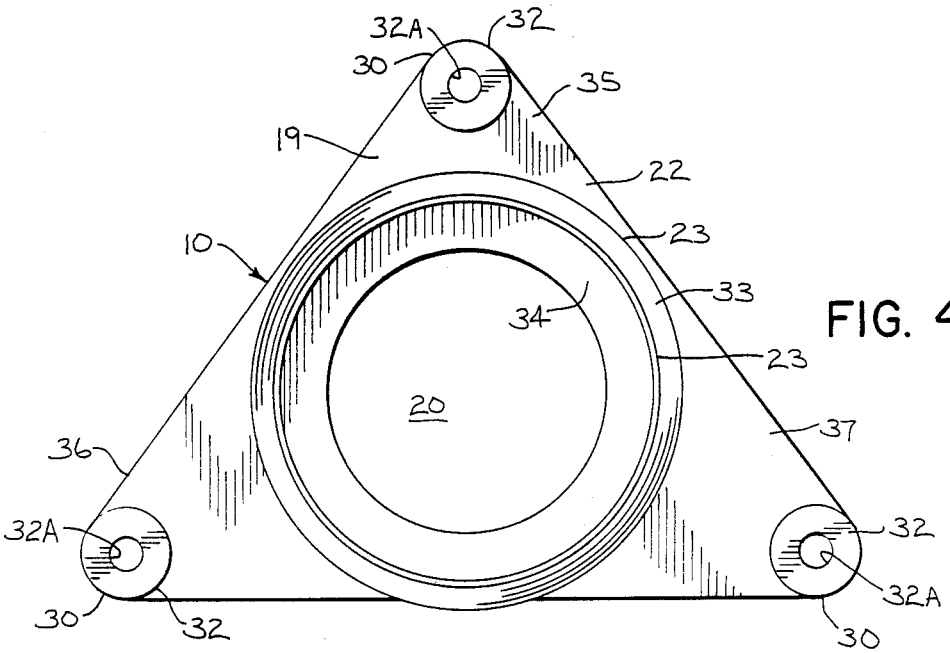
FIG. 4 is a bottom plan view of the gasket illustrated in the previous figures.

Referring specifically to FIG. 4, it will be noted that the wall 19 as it extends from the lip member 33 provides three flat walled flange portions 35, 36 and 37. In this particular geometric configuration the connectors 30 are positioned at the apexes of these portions. It will be particularly noted that the flange portions 35, 36 and 37 provide an overall geometric configuration in the form of an isosceles triangle.

ASSEMBLY

Figure 2:
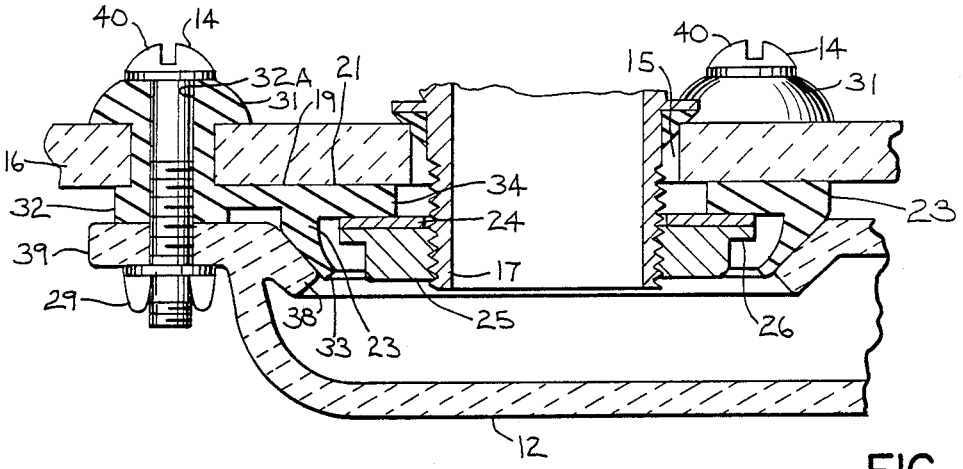
FIG. 2 is an enlarged partial view in vertical section showing the toilet tank gasket assembled between the toilet tank and the toilet bowl.
Figure 3:
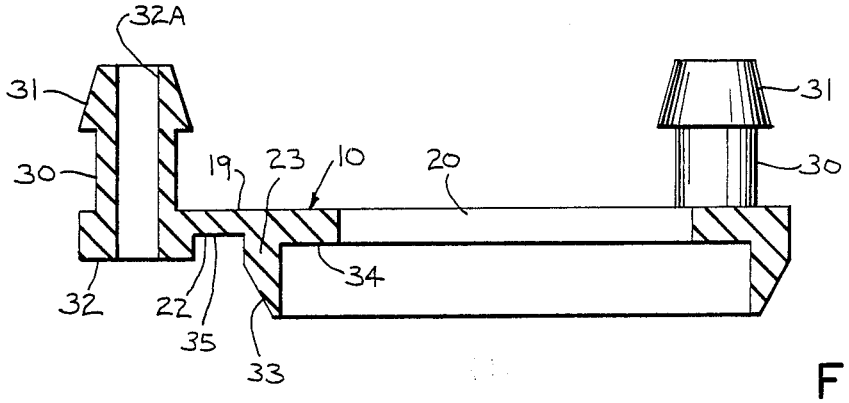
FIG. 3 is another enlarged partial sectional view of just the toilet tank gasket of this invention.

A better understanding of the advantages of the toilet tank gasket 10 of this invention will be had by a description of its assembly. Referring to FIGS. 1 and 2 specifically, the gasket 10 will be orientated with respect to the toilet tank 11 in a manner shown in FIG. 1. This will be with the openings 32A orientated with the openings 13 of the toilet tank 11 member and 28 of the bowl extension, and the opening 20 of the gasket 10 aligned with the openings 15 of the toilet tank and 27 of the bowl extension.

The frusto-conical member portions 31 of the washer heads will be force fitted through the openings 13 until they will snap in place (they are thus expansion fitted therein by camming therethrough). They then are *inside* the bottom tank wall 16 as indicated in FIG. 2. But in this position the gasket will be held in place under the tank in proper automatic alignment with the threaded portion 17.

The next step in assembly is the placement of the friction washer 24 against the inner washer ledge 34 and screwing the valve nut 25 onto the threaded portion 17 so as to sandwich the friction washer 24 as well as the washer ledge 34 against the outside of the bottom wall 16 of the toilet tank. With the gasket member 10 positioned with respect to the toilet tank 11 and the flush valve 18 also secured thereto, the next assembly step is the attachment to the toilet bowl extension 12. This will be effected by locating the toilet tank 11 so that the openings 13 are orientated with the openings 28 of the toilet bowl extension 12 as well as with the connectors 30. When this is effected, the bolts 14 will be placed therethrough in a manner indicated in FIG. 2, and the nuts 29 attached so that they will contact the under surface of the flange 39 of the toilet bowl extension.

It will be specifically noted in conjunction with FIG. 2 that the flange 39 of the toilet bowl 12 has a curved surface 38 for better contact with the ring lip 33 of the gasket member 10. Also as best seen in FIG. 2, as the nuts 29 are fastened onto the bolts 14 the heads 40 of the bolts will compress the frusto-conical portions 31 of the sealing members 30 so that they assume a more perfect mushroom-type configuration. Further, it will be noted that the spacing members 32 will provide the proper spacing and cushioning of the flange 39 of the toilet bowl extension 12 from the bottom wall 16 of the toilet tank 11.

It will thus be seen that an important feature of the gasket member 10 of this invention is its ease of assembly. Separate washer parts are eliminated and proper alignment of all parts is quickly achieved. Further, since only a single large gasket element is used, loss of small washers does not occur nor does failure to include washers during assembly occur. Also, less plumbing skill is required to use this gasket, and a handyman at home is therefore more likely not to need to hire a skilled plumber when installing a toilet.

Rubber is the preferred material for the gasket, but other materials may also suffice if they have appropriate sealing and compression characteristics. Also, while three connectors have been illustrated for use with the gasket member, any number of such connectors could be utilized, depending upon the number of threaded fastening elements required. Further, the washer ends of the connectors have been illustrated as being frusto-conical in configuration. Many other enlargements forming the washer heads (e.g., spheres) could as effectively be utilized to provide the expansion fit. Also, while a integral unit made of a single material is shown, separately made parts could be assembled into one piece unit, yet follow the present design.

Thus, while a preferred embodiment has been described above, it is readily apparent to those skilled in the art that a number of modifications and changes may be made without departing from the spirit and scope of the invention. Therefore, it is intended that the scope of the invention should not be limited by the description of the preferred embodiment, but only by the claims which follow.

I claim:

1. A one-piece gasket for sealing engagement between a bottom surface of a toilet tank that has a tank outlet opening therethrough, and an upper surface of a toilet bowl extension that has an inlet opening therethrough, said gasket being suitable for use when the tank and bowl extension are secured together by a fastener extending through fastener holes in the tank bottom and extension top, comprising:

a resilient gasket wall having an opening therethrough that is alignable with the tank outlet and extension inlet, said gasket wall having a sealing portion around said gasket opening that is suitable to be sandwiched by the tank bottom and bowl extension top;

a connector integrally attached to said gasket wall and extending upward therefrom, said gasket wall defining between said connector and said sealing portion a flexible narrowed hinging flange portion, said gasket wall extending directly from said sealing portion to said connector to provide a triangular connecting web, said connecting web surrounding said connector along those portions of the connector facing said sealing portion, a triangular portion of the web being opposite the portion of said connector which is disposed away from said sealing portion, said connector having an axial fastener through bore and also having an enlarged integral washer head adjacent to its upper end, said washer head having a sloped top portion and being spaced from said gasket wall, said washer head constructed and arranged to be able to be compression fitted through a tank bottom fastener hole;

whereby said axial through bore may be aligned with a tank fastener hole when the gasket wall opening has been aligned as aforesaid, and the washer head may be positioned at the side of the fastener hole opposite said gasket wall to form a washer in the tank when the gasket wall is still outside the tank; and wherein a thickened resilient bumper section is formed integrally with the gasket wall so as to be suitable to surround a portion of the fastener hole under the tank, so as to provide a cushion between the tank and the extension.

2. The gasket of claim 1, wherein said connectors are mushroom connectors.

3. The gasket of claim 1, wherein said gasket is formed of rubber.

4. The gasket of claim 1, wherein a ledge portion is positioned adjacent said sealing portion for engagement by a nut member.

5. The gasket of claim 1, wherein said gasket wall has a triangular configuration for its top view periphery and there are three connectors, and each is disposed adjacent the apex of said triangle.

6. The gasket of claim 1, wherein said bumper section completely surrounds said fastener hole.

* * * * *

UNITED STATES PATENT AND TRADEMARK OFFICE

CERTIFICATE OF CORRECTION

PATENT NO. : 4,757,560

DATED : July 19, 1988

INVENTOR(S) : Ronald N. Grimstad

It is certified that error appears in the above-identified patent and that said Letters Patent is hereby corrected as shown below:

Column 2, line 68 After "portions." insert --The flat flange portions 35, 36 and 37 extend directly from the sealing ring 23 to the connectors 30 to provide a triangular connecting web. The web surrounds the connectors 30 along those portions facing the sealing ring 23. In this manner the webs are directly opposite the portions of the connectors 30 which extend away from the sealing ring 23.--

Signed and Sealed this

Fourteenth Day of March, 1989

*Attest:*

DONALD J. QUIGG

*Attesting Officer*

*Commissioner of Patents and Trademarks*